US007275996B2

(12) United States Patent
Dillner et al.

(10) Patent No.: US 7,275,996 B2
(45) Date of Patent: Oct. 2, 2007

(54) INFANT SWING

(75) Inventors: James Dillner, Leola, PA (US); Kenneth Waldman, Reading, PA (US); Jerome Drobinski, Reading, PA (US)

(73) Assignee: Simplicity, Inc., Reading, PA (US)

( * ) Notice: Subject to any disclaimer, the term of this patent is extended or adjusted under 35 U.S.C. 154(b) by 469 days.

(21) Appl. No.: 10/910,160

(22) Filed: Aug. 3, 2004

(65) Prior Publication Data

US 2006/0030415 A1 Feb. 9, 2006

(51) Int. Cl.
*A63G 9/16* (2006.01)

(52) U.S. Cl. ..... 472/119

(58) Field of Classification Search ..... 472/118–125; 297/273; 248/188.4, 688
See application file for complete search history.

(56) References Cited

U.S. PATENT DOCUMENTS

| | | | | |
|---|---|---|---|---|
| 2,520,377 | A | 8/1950 | Schrougham | |
| 3,649,074 | A | 3/1972 | McDonald et al. | |
| 3,731,342 | A | 5/1973 | Cousin | |
| 3,883,136 | A | 5/1975 | Kim | |
| 4,240,625 | A | 12/1980 | Meeker | |
| 4,324,432 | A | 4/1982 | Eldon, III et al. | |
| 4,325,578 | A | 4/1982 | Borucki | |
| 4,382,595 | A * | 5/1983 | Tolar | 472/118 |
| 4,697,845 | A | 10/1987 | Kamman | |
| 5,393,268 | A * | 2/1995 | Cunard et al. | 472/120 |
| D368,816 | S | 4/1996 | Mitchell et al. | |
| 5,562,548 | A | 10/1996 | Pinch et al. | |
| 5,653,417 | A * | 8/1997 | DeBarber et al. | 248/688 |
| 5,803,817 | A | 9/1998 | Stern | |
| 5,803,818 | A | 9/1998 | Tseng | |
| 5,951,108 | A | 9/1999 | Bauer et al. | |
| 5,975,631 | A | 11/1999 | Fair et al. | |
| 5,984,791 | A | 11/1999 | Fair et al. | |
| 6,022,277 | A | 2/2000 | Jankowski | |
| 6,024,410 | A | 2/2000 | Yoshida | |
| 6,027,409 | A | 2/2000 | Favorito et al. | |
| 6,193,224 | B1 | 2/2001 | Dillner et al. | |
| 6,251,023 | B1 * | 6/2001 | Lauro et al. | 472/118 |
| 6,386,986 | B1 | 5/2002 | Sonner et al. | |
| 6,471,597 | B1 * | 10/2002 | Flannery et al. | 472/119 |
| 6,520,862 | B1 * | 2/2003 | Armbruster et al. | 472/118 |
| 6,626,766 | B1 * | 9/2003 | Hsia | 472/119 |
| 6,645,080 | B1 * | 11/2003 | Greger et al. | 472/118 |
| 6,666,505 | B2 | 12/2003 | Greger et al. | |
| 6,702,685 | B2 * | 3/2004 | Mahlstedt et al. | 472/118 |
| 6,705,950 | B2 * | 3/2004 | Wood et al. | 472/118 |
| 6,896,624 | B2 * | 5/2005 | Longenecker et al. | 472/119 |
| 2003/0160487 | A1 | 8/2003 | Flannery et al. | |
| 2004/0102253 | A1 | 5/2004 | Ransil et al. | |

FOREIGN PATENT DOCUMENTS

| | | |
|---|---|---|
| GB | 2 358 793 A | 8/2001 |

* cited by examiner

*Primary Examiner*—Kien Nguyen
(74) *Attorney, Agent, or Firm*—Volpe and Koenig, P.C.

(57) ABSTRACT

An infant swing comprises a seat with a padded seating area for an infant and a seat frame that supports said padded seating area, the seat frame comprising at least two upwardly extending arms. The swing also comprises two pivot housings rotatably connected to the at least two upwardly extending arms; a support frame that extends upwardly from a substantially planar surface, the support frame engaging the pivot housings and allowing the seat to rotate freely about the pivot housings; and at least two feet in contact with the substantially planar surface, engaging the frame, and extending outside an outer perimeter of the frame.

11 Claims, 10 Drawing Sheets

FIG.4
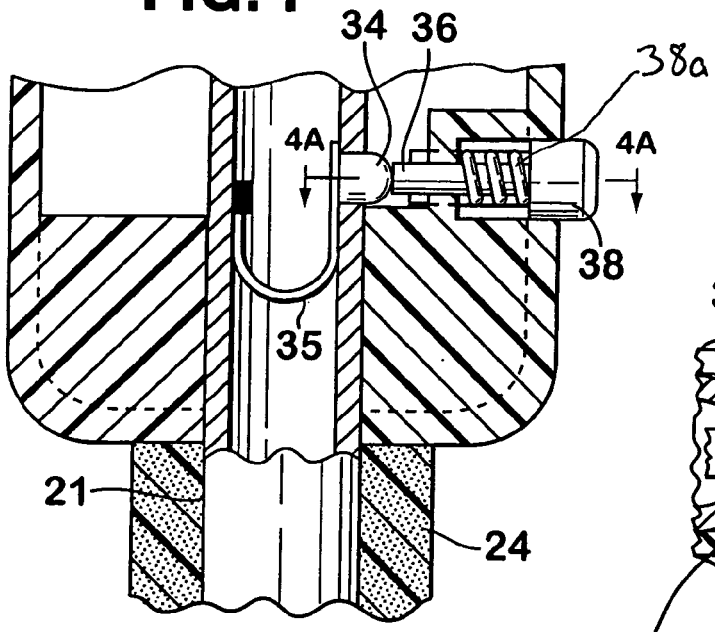
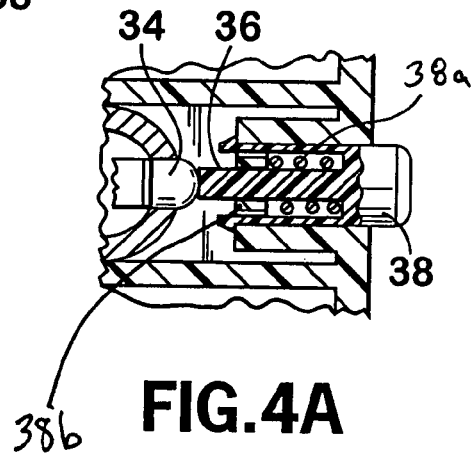
FIG.4A
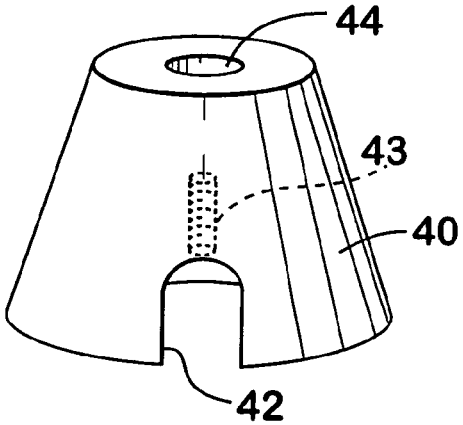
FIG.6
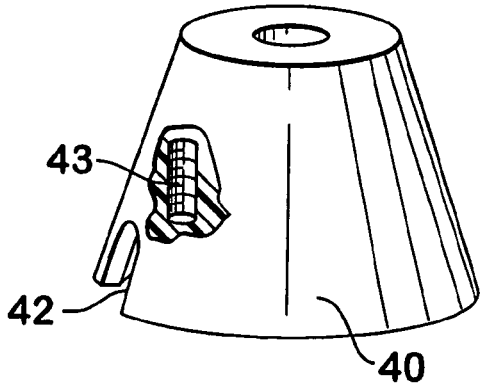
FIG.6A

FIG. 12
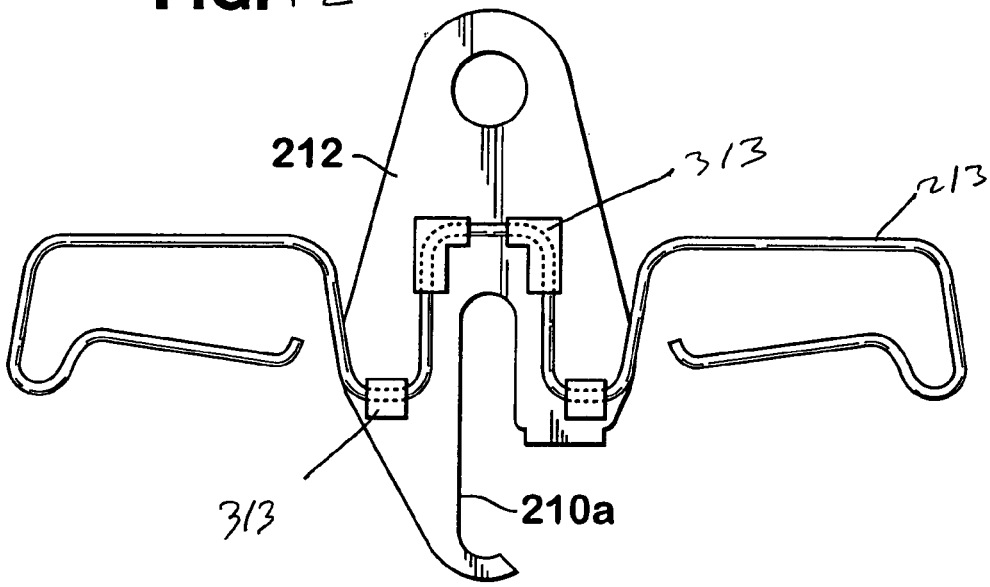
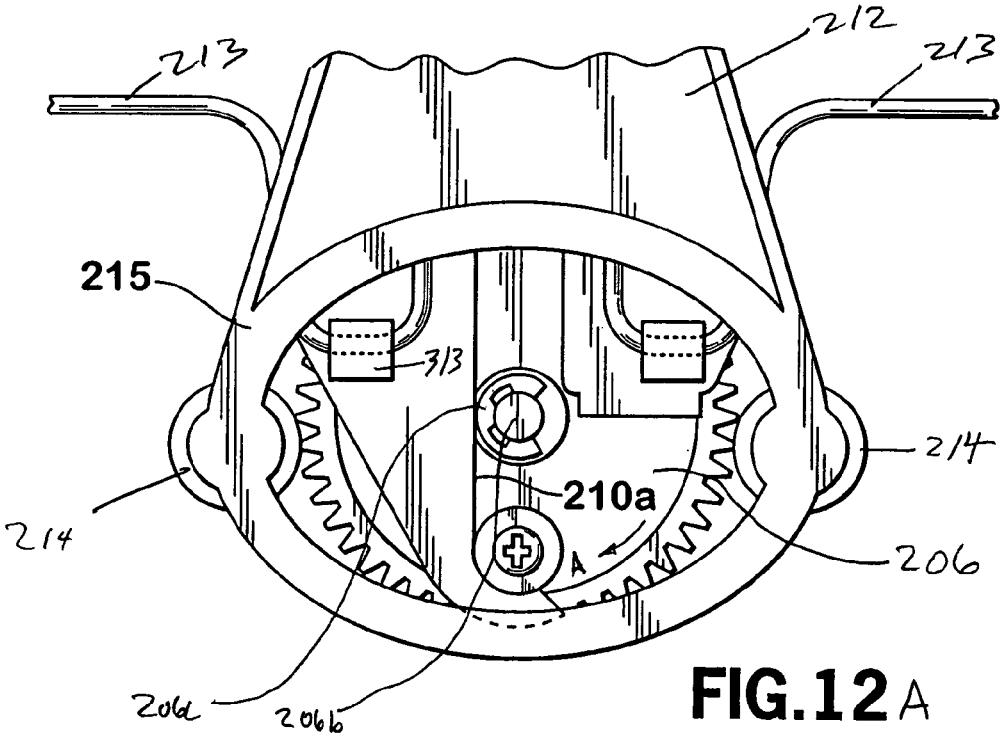
FIG. 12A

INFANT SWING

FIELD OF INVENTION

This invention relates to a motorized infant swing.

BACKGROUND

Infant child swings provide entertainment for children too small to operate a normal swing. Although early swings used mechanical motors to drive the child, modern infant swings use an electrocmechanical motor assembly. There are several design concerns for swing design. First, a swing must be stable and safe. Second, the swing should have maximum battery life. Third, a child should be comfortable and entertained in the swing. Fourth, the swing should be able to be easily packed and stored.

SUMMARY

The swing described herein addresses all of these design concerns. An infant swing comprises a seat with a padded seating area for an infant and a seat frame that supports said padded seating area, the seat frame comprising at least two upwardly extending arms. The swing also comprises two pivot housings rotatably connected to the at least two upwardly extending arms; a support frame that extends upwardly from a substantially planar surface, the support frame engaging the pivot housings and allowing the seat to rotate freely about the pivot housings; and at least two feet in contact with the substantially planar surface, engaging the frame, and extending outside an outer perimeter of the frame.

BRIEF DESCRIPTION OF THE DRAWING(S)

FIG. 4 shows the cross sectional view along the lines 4—4 in FIG. 1.

FIG. 4A shows the cross-sectional view along the lines 4A—4A in FIG. 4.

FIG. 6 shows a perspective view of a swing foot.

FIG. 6A shows a perspective side view of the swing foot of FIG. 6 showing the open cylinder in a partial cutaway.

FIGS. 12 and 12A show an alternate embodiment of the arm plate.

DETAILED DESCRIPTION OF THE PREFERRED EMBODIMENT(S)

Figure 1:
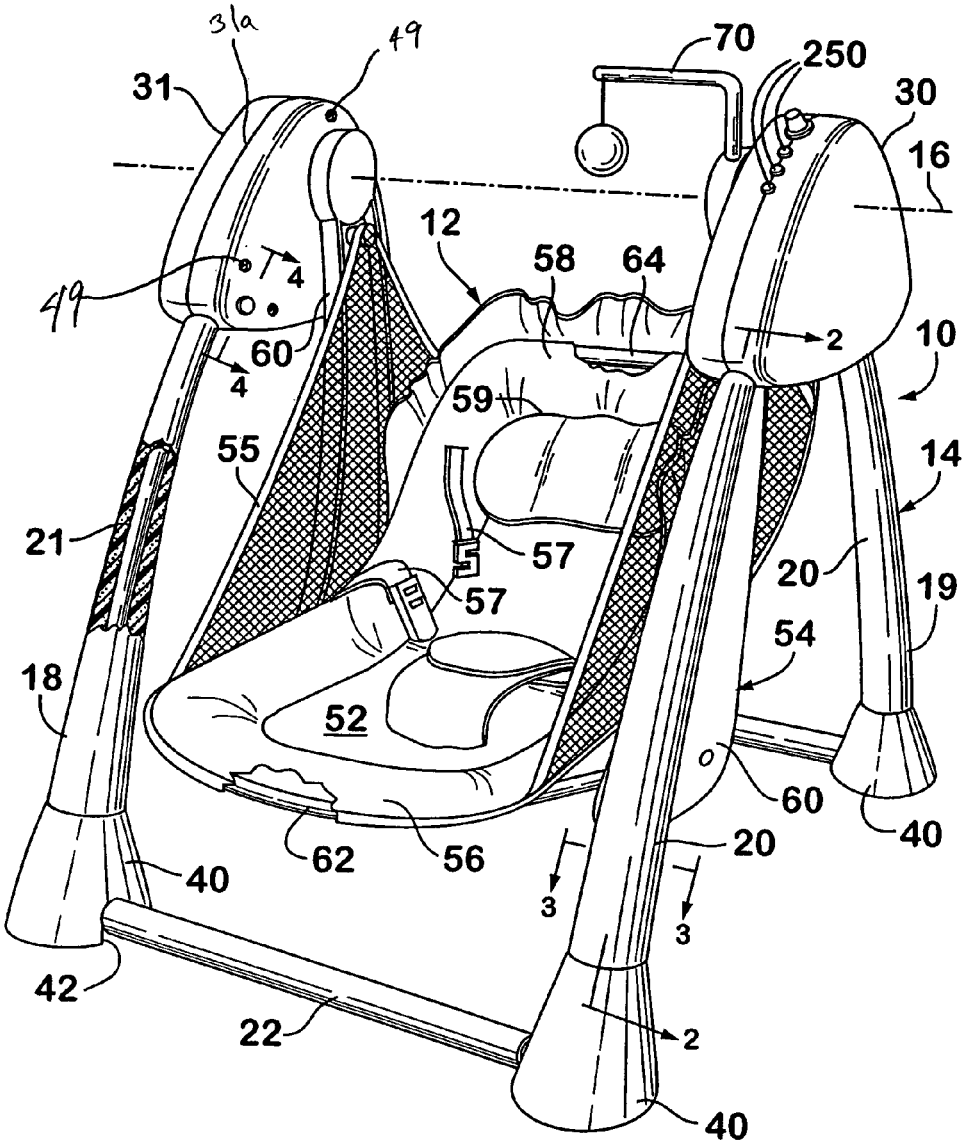
FIG. 1 shows a perspective view of the swing with partial cutaways of the seat and one support.

FIG. 1 shows a swing 10 having a support frame 14 that supports a hanging padded seat 12 that synchronously swings about an axis of rotation 16.

Figure 2:
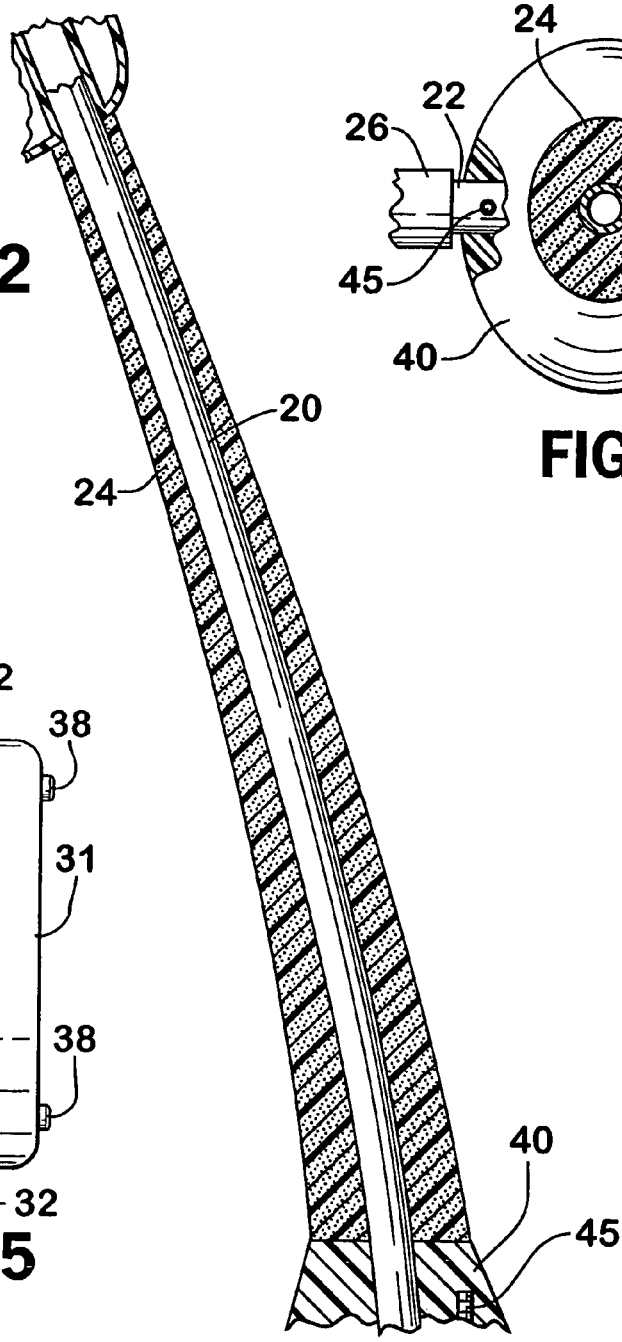
FIG. 2 shows the cross sectional view along the lines 2—2 in FIG. 1.
Figure 3:
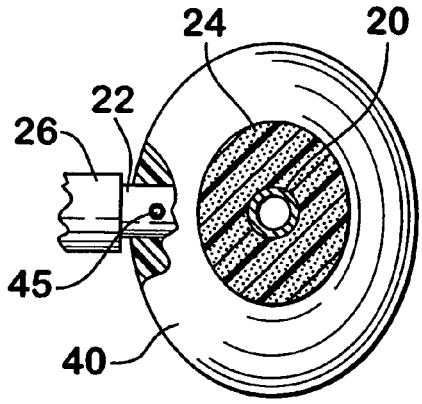
FIG. 3 shows the cross sectional view along the lines 3—3 in FIG. 1.

The frame 14 has two pair of front and rear spaced apart members 18, 19 (one member 19 being obscured from view. Preferably, the spaced apart members 18, 19 are curved and comprised of legs, two parallel and generally vertical, curved legs 20, 21 (the cutaway in FIG. 2 shows leg 21 beneath foam padding 24). The front and rear legs are joined by a horizontal support leg 22. FIGS. 1–3 show the foam padding 24 covering the curved members 18, 19. The padding 24 on the legs 20, 21 is thicker at the base of each parallel leg than at the top of the leg. This extra padding provides more cushioning in areas where the swing will be bumped more, i.e. the bottom of the swing. Support leg padding 26 covers the horizontal support leg 22 in a generally uniform manner.

FIGS. 3, 6, and 6A show a foot 40 with a through-hole 44 that receives a leg 20, 21 and an opening 42 that receives the support leg 22. The frame's oversized semi-conical feet 40 extend outside the perimeter of the frame 14 to provide extra stability to the swing 10 during operation. The foot 40 preferably includes an open cylinder 43 that accepts a fastener 45, such as a screw or compression fitted snap member that secures it to the support leg 22. Of course, the foot 40 could be attached to the leg 20, 21 in any similar manner (not shown).

Figure 5:
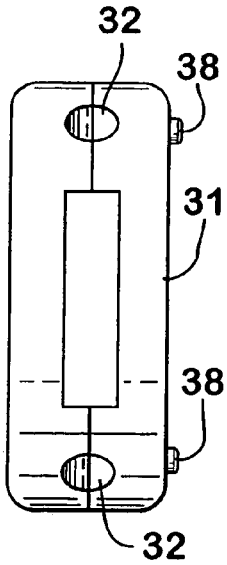
FIG. 5 shows a bottom view of the pivot housing.

With reference to FIG. 4, The parallel legs 20, 21 removably attach to pivot housings 30, 31 by sliding the legs 20, 21 into recesses 32 in the pivot housings, as shown in FIGS. 1, 4, and 5. The legs 20, 21 each contain a spring-biased push button 34 that engages a corresponding button end 36 within the pivot housing 30. Pressing on the spring biased release button 38 (biased by spring 38*a* that presses against the button 38 and stop 38*b*) drives the button end 36 against the push button 34, which allows the leg 21 to be removed from the hole 32. FIG. 4 shows a leaf spring 35 as the bias element for the leg button 34, however, other bias means such as compression springs or elastomeric filler could be used.

With reference to FIG. 1, the seat 12 comprises a padded seat cover 52 and a seat frame 64. The padded seat cover has a leg portion 56 and a back portion 58, upon which a child's legs and back respectively rest. The padded seating area 52 also has a harness 57 that secures the child in the swing 10, and a padded headrest 59 for the child's head. The harness engages the child's groin and shoulders. Webbing 55 (or other preferably flexible material could be used) attached to the seat 12 discourages a child from reaching into the path of the swinging seat 12 where a hand or leg could be injured.

The seat frame comprises at least one (although two are shown) upwardly extending arms 60. The seat frame includes a leg member 62 and a back member 64 shown with the padding removed in FIG. 7. The members 62, 64 are contained within pockets in the padded seat 52 and provide a stable surface for the child to sit upon.

The members 62, 64 are each rotatably connected to the upwardly extending arms 60, such that the seat can be folded onto itself for storage, or reclined for comfort. Reclining the seat about pins 61 is possible by adjusting strap 63 that is connected to the padded seat cover 52. The seat back portion 58 cannot extend beyond a certain incline due to stops 67 positioned on the upwardly extending arms 60. Further, the stops do not prevent rotation in the path of reclination because the stops 67 have rounded out portions 67*a* that allow for rotation of the back and seat portions.

Figure 13:
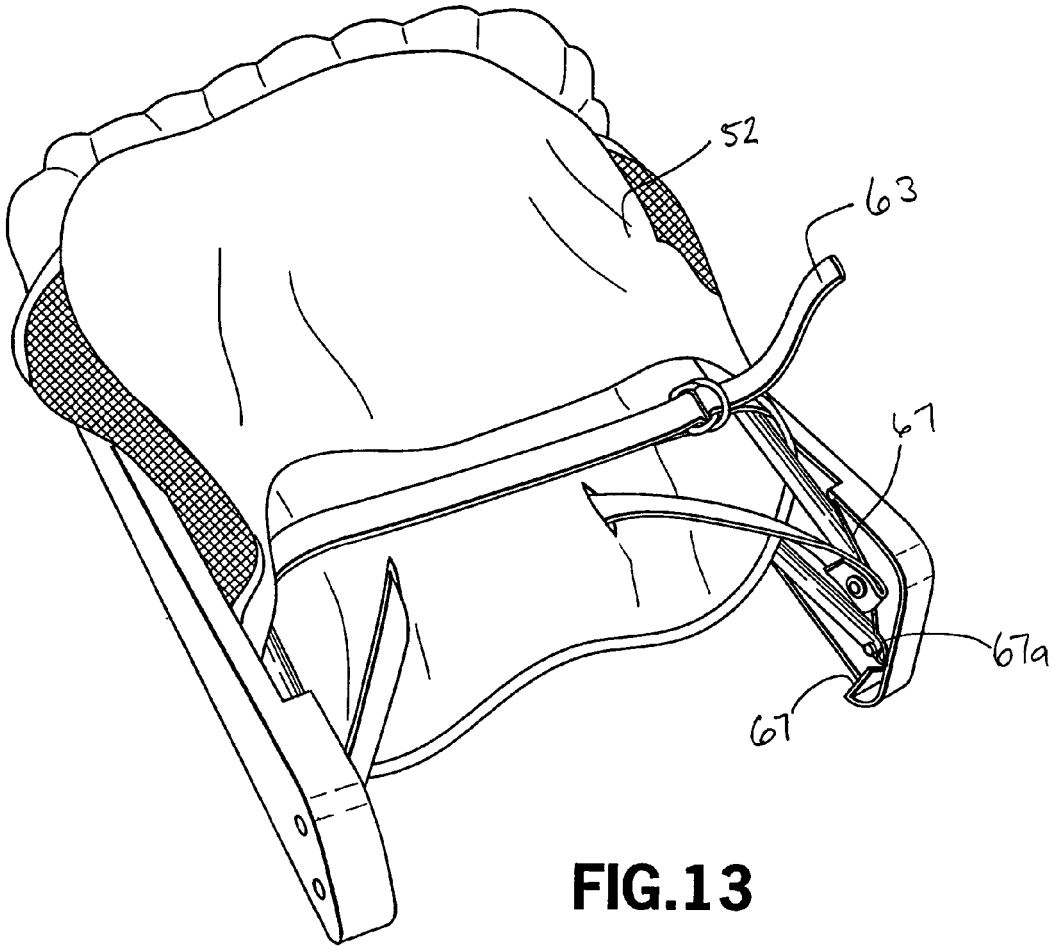
FIG. 13 shows a back view of the seat.

Folding for storage is best accomplished with the U-shaped members 18, 19 removed from the housings 30, 31, and the seat folded on itself as shown in FIG. 13.

Figure 7:
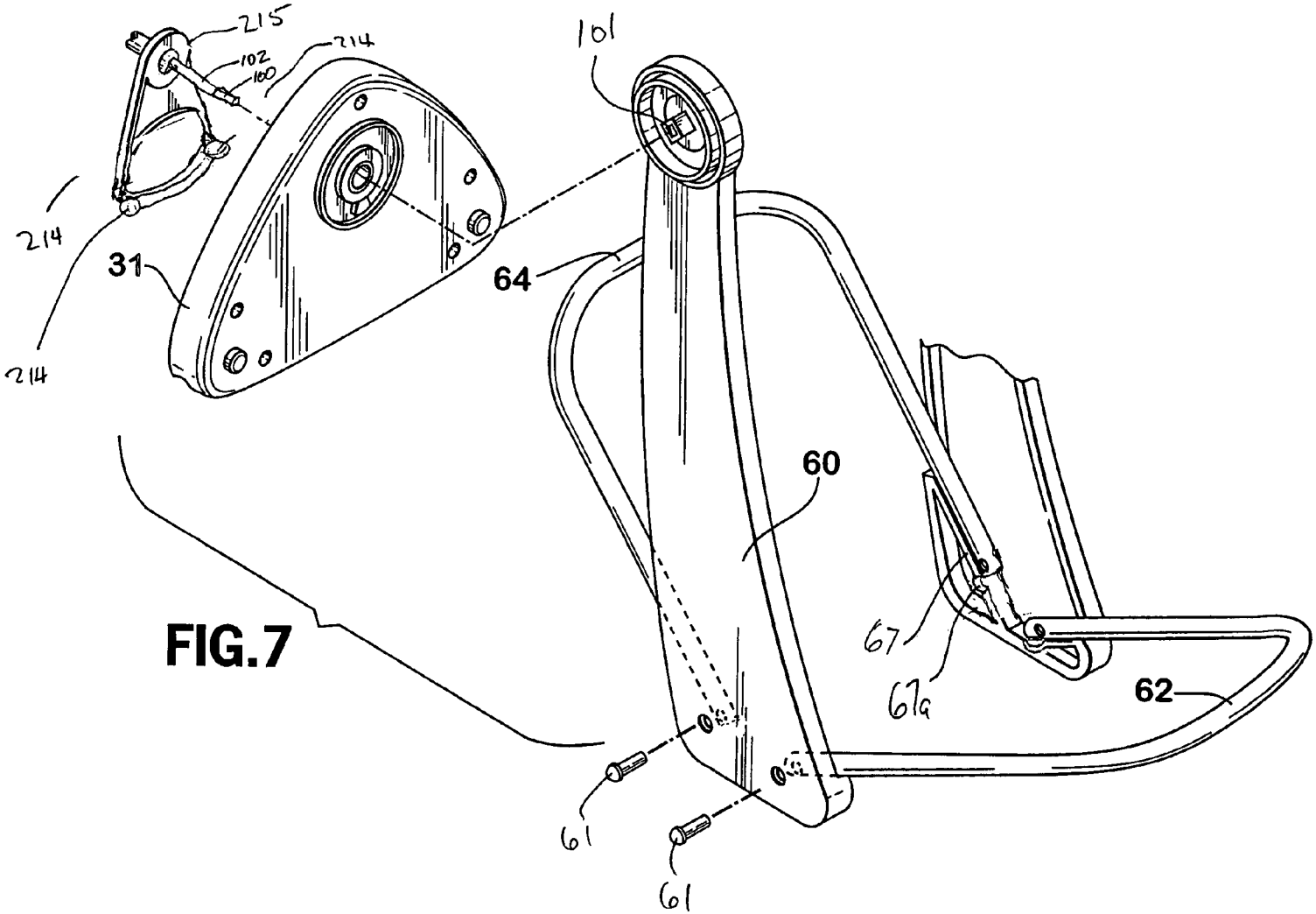
FIG. 7 shows the seat and pivot housing engagement.

As shown in FIG. 7, the arms 60 matingly engage an outward extending end 100 of a shaft 102. The square end 100 of the shaft 102 engages with the square receiving hole 101 in the arm 60 to matingly engage the arm 60 and pivot housing 31. As the square end of the shaft rotates (driven by a motor discussed below), the seat 12 moves through its synchronous arc. The shaft 102 is rotatably disposed in the pivot housing 30 by means of bearing 104 having a hole 106 therethrough. The bearing is slididably engaged, such that it can only be removed to the interior of the housing 30, within a bearing hole 105, shown in FIG. 11.

FIGS. 8–11 show the motor assembly 200 contained within one half of the pivot housing 30 (the pivot housing 30 splits along seam 31*a* and each half of the housing is joined using screws 49 that extend from one half of each housing to the other.

In operation, the motor 202, which is preferably battery operated by batteries contained within the battery housing 203, turns a spinning worm gear 204. Screws 204*a* and bracket 204*b* hold the motor 202 within its shaped housing 205 formed on the interior wall 30*a* of the pivot housing 30.

The spinning worm gear 204 meshingly engages and turns a toothed gear 206 in the direction indicated by arrow A. A C-clip 206*a* connects the toothed gear 206 to a gear seat pin 206*b* having a groove 206*c* thereon that engages the clip 206*a* about which the gear 206 can freely rotate. The toothed gear 206 includes a rod 208 mounted to a seat 209, displaced from the center of gear 206, by means of a screw 207. The rod 208 moves within a slot 210 (embodiment shown in FIGS. 8–10) or partial slot 210*a* (embodiment shown in FIGS. 11, 12, and 12A) in an arm plate 212. The rod's motion within transverse to the slot moves the arm plate 212 in a reciprocating fashion. One or more arms 213 mounted on the arm plate 212 within seats 313, push a stud 214 (or two studs in the case of two arms) mounted on a stud plate 215. The arms 213 are preferably made from thin flexible wire, and as shaped in the above-mentioned Figures, the arms are more prone to resist bending with time, as opposed to the straight arms 652 shown in U.S. Pat. No. 6,626,766 to Hsia.

The stud plate 215 shares the axis of rotation with the seat, but rotates freely with respect to the arm plate 212, and also turns the shaft 102. Turning the shaft 102 moves the upwardly extending arms 60, which in turn moves the seat through its synchronous arc.

The embodiments shown in FIGS. 8–10 and 11–12A are somewhat different. In both embodiments, the arm plate 212 includes a hollow cylindrical sleeve 220 rotatably mounted on the shaft 102. Preferably, one or two C-shaped clips 222 are fitted within an annular groove 224 (shown in FIG. 11) in the shaft 102 to prevent axial displacement of the sleeve 220.

Figure 8:
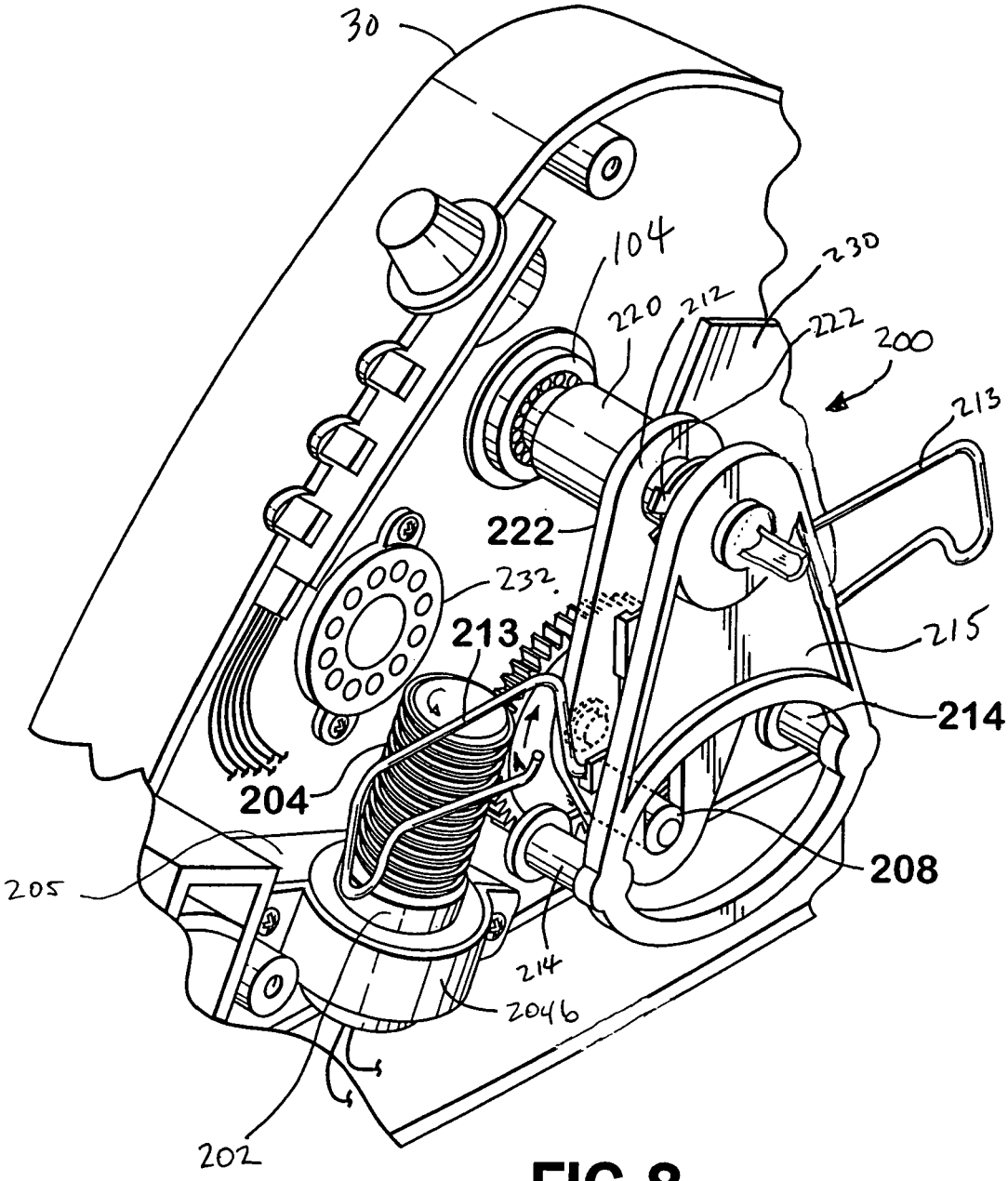
FIGS. 8–10 show the interior of the pivot housing showing the motor assembly.
Figure 9:
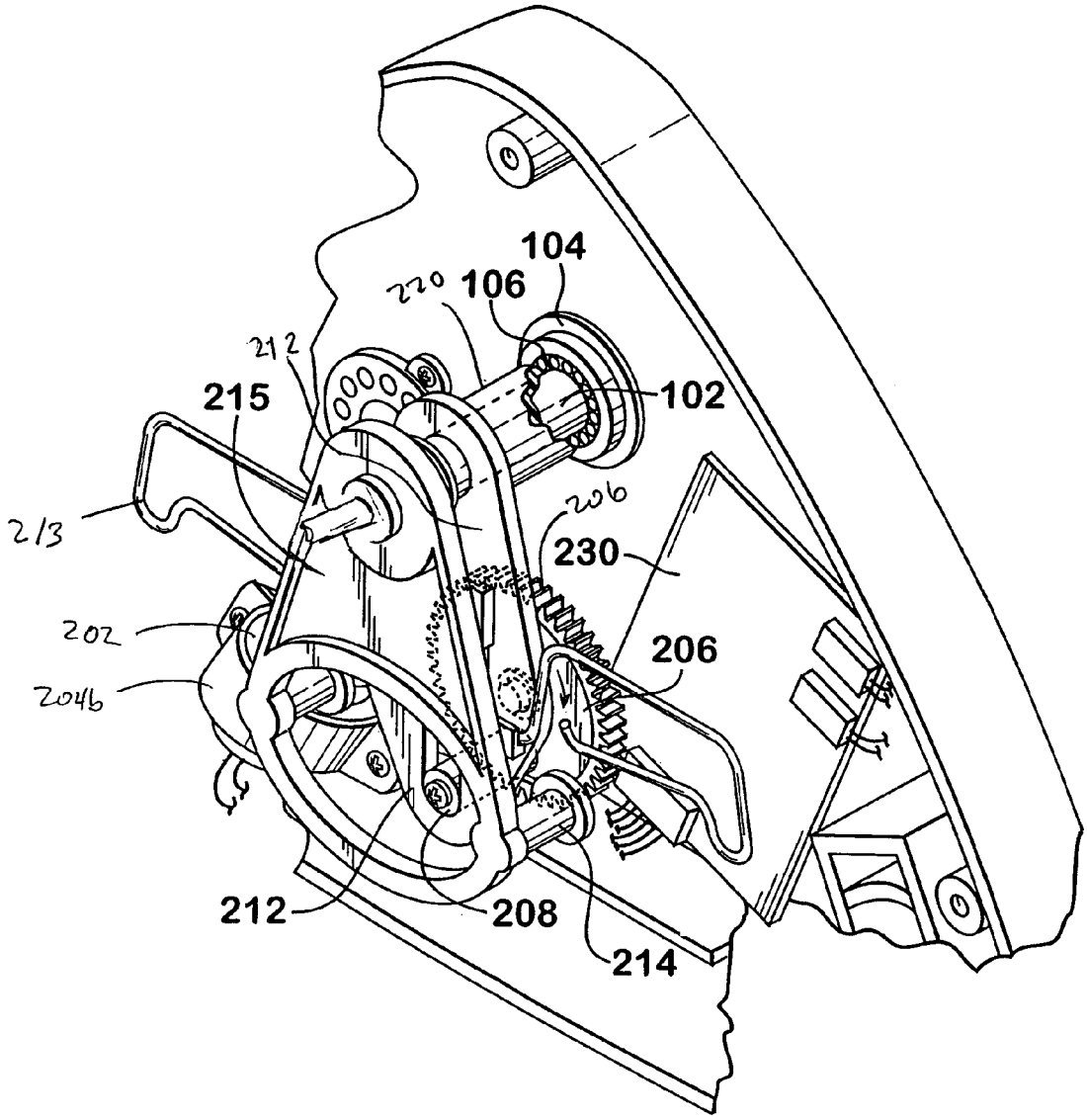
Figure 10:
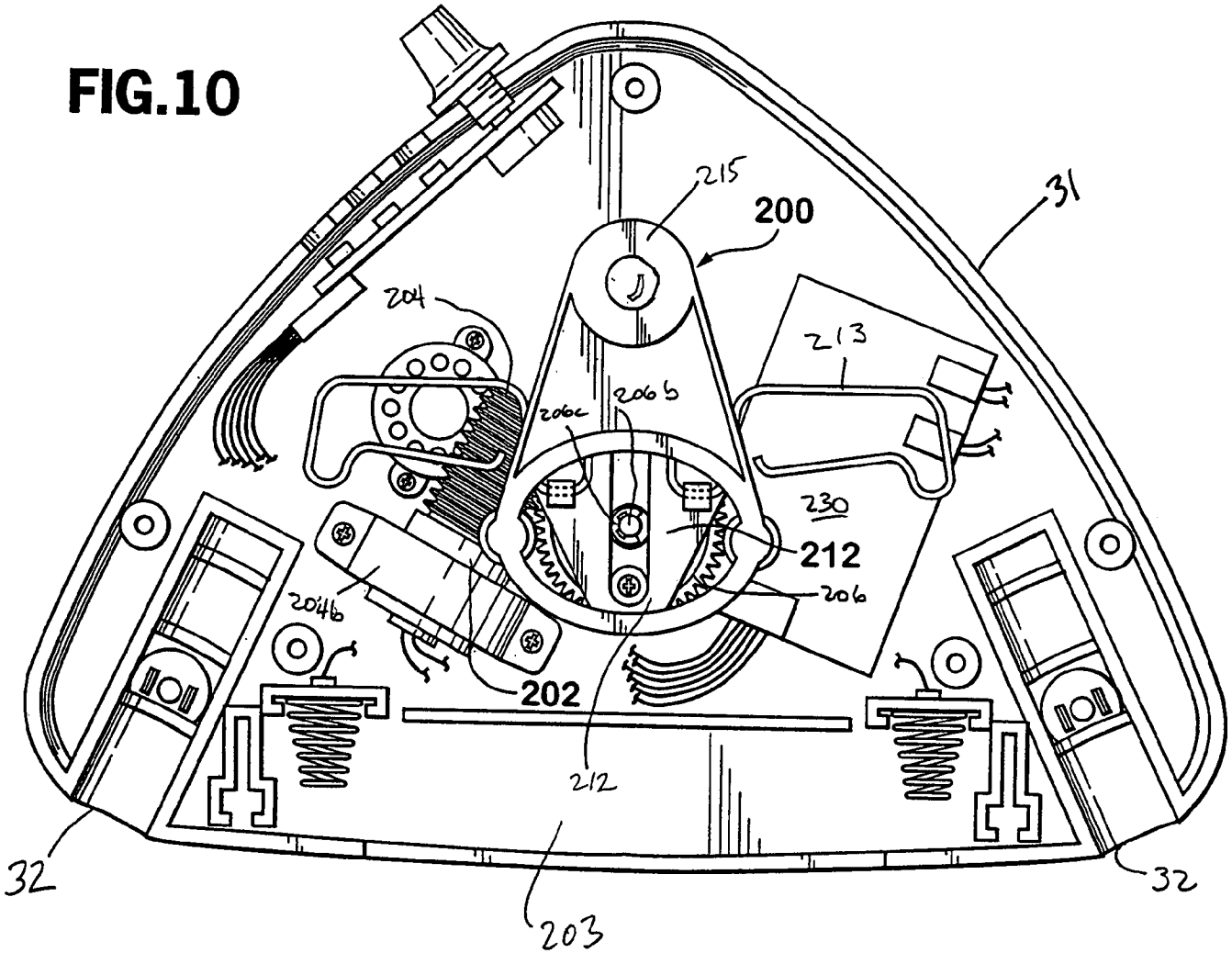

The embodiment shown in FIGS. 8–10 uses two arms 213 on either side of the arm plate 212 to push against the studs 214 and thus the motor drives the seat through both directions of its synchronous arc. Each of the arms 213 engage each of the two studs 214 in such a manner that swinging of the arm plate 212 about the axis of rotation 16 results in alternate pushing of the studs 214 by the arms 213, which, in turn, results in a synchronous swinging of the upwardly extending arms 60 about the axis of rotation 16.

Figure 11:
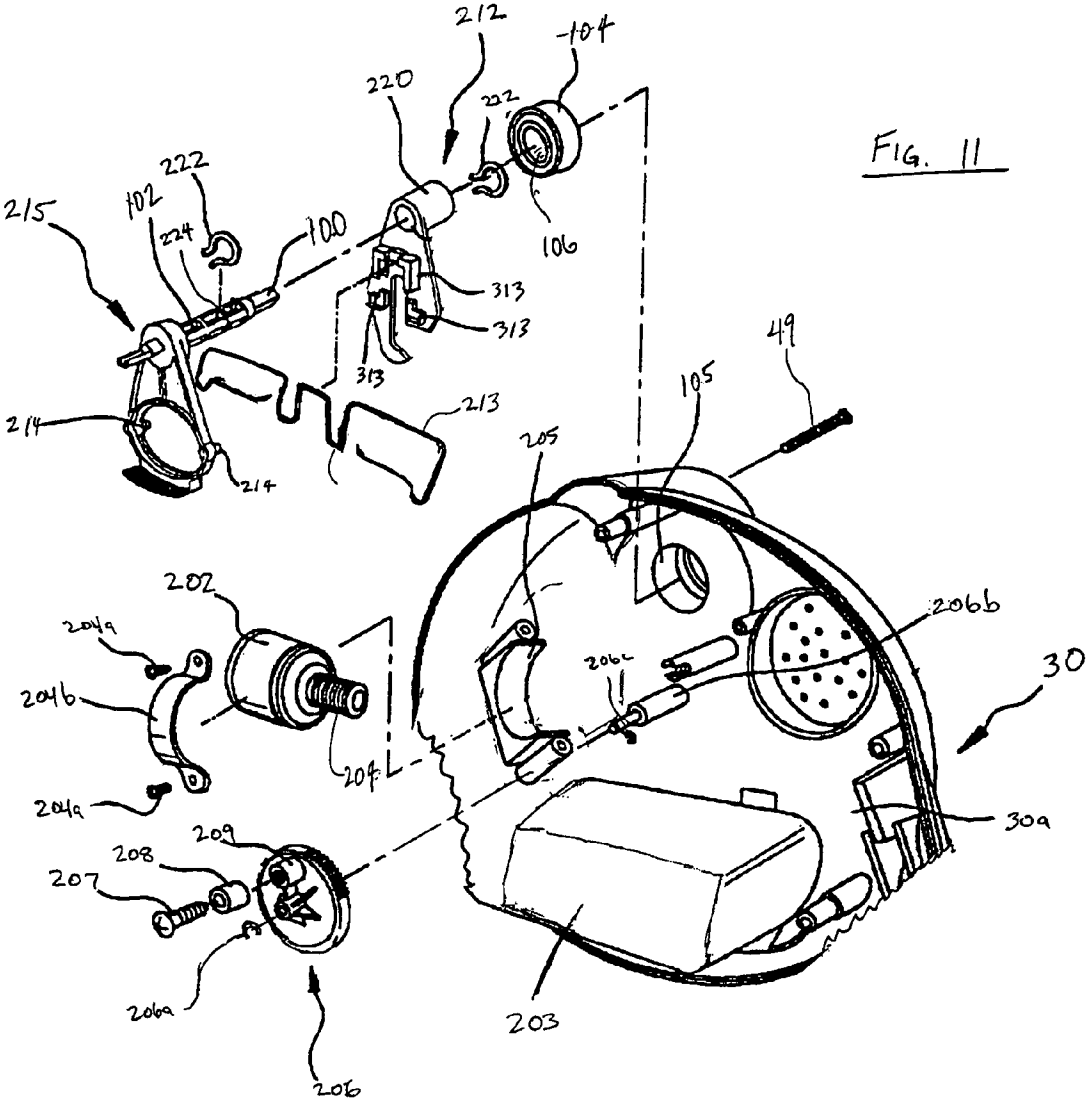
FIG. 11 shows an exploded view of the motor assembly.

The embodiment shown in FIGS. 11, 12, and 12A, by contrast, uses a single arm 213 to move the seat along one direction of its synchronous arc. During the return path, the seat falls along the path due to gravity because the partial slot 210*a* does not engage the post 208 during the "free fall" of the swing. Further, during this fall, the motor is not pushing the swing, which saves wear on the motor because it only operates to push the swing in one direction. Finally, less plastic material is needed in the arm plate 212.

External buttons 250 on the pivot housing 30 containing the motor operate the motor 202. The buttons activate the motor and adjust its speed, which in turn adjusts the speed of the seat 12 along the synchronous arc.

Buttons 250 on the housing also activate a sound system that can play music or sounds to entertain or soothe a child. The sound system is run by the circuit board 230 and the sound is generated through a speaker 232. Buttons and/or dials 250 turn the system on, make adjustments in volume, change the station, and/or change the sound generated.

A decorative display 70 mounts on the upwardly extending arm 60 to entertain the child. Such a display 70 could be removable if the child did not like it, or could have a mobile type toy attached thereto that swings with the motion of the seat along its synchronous arc.

What is claimed is:

1. An infant swing comprising:

a seat for holding an infant, the seat comprising a padded seating area for an infant and a seat frame that supports said padded seating area, the seat frame comprising at least two upwardly extending arms;

two pivot housings rotatably connected to the at least two upwardly extending arms;

a support frame that extends upwardly from a substantially planar surface, the support frame engaging the pivot housings and allowing the seat to rotate freely about the pivot housings;

at least two feet in contact with the substantially planar surface, engaging the frame, and extending outside an outer perimeter of the frame; said padded seating area further comprising a strap for adjusting a recline of a back portion of the seating area.

2. An infant swing comprising:

a seat for holding an infant, the seat comprising a padded seating area for an infant and a seat frame that supports said padded seating area, the seat frame comprising at least two upwardly extending arms;

two pivot housings rotatably connected to the at least two upwardly extending arms;

a support frame that extends upwardly from a substantially planar surface, the support frame engaging the pivot housings and allowing the seat to rotate freely about the pivot housings;

at least two feet in contact with the substantially planar surface, engaging the frame, and extending outside an outer perimeter of the frame; wherein:

the support frame is removably connected to the pivot housings, and the removable connection comprises at least one spring biased first push button extending from the support frame that engages a receiving channel in the pivot housing and a manually operable, spring biased second push button arranged on said pivot housing and engaging said first push button to release the first push button from said receiving channel when the second push button is depressed.

3. An infant swing comprising:

a seat for holding an infant, the seat comprising a padded seating area for an infant and a seat frame that supports said padded seating area, the seat frame comprising at least two upwardly extending arms;

two pivot housings rotatably connected to the at least two upwardly extending arms;

a support frame that extends upwardly from a substantially planar surface, the support frame engaging the pivot housings and allowing the seat to rotate freely about the pivot housings;

at least two feet in contact with the substantially planar surface, engaging the frame, and extending outside an outer perimeter of the frame; wherein:

the support frame comprises two generally U-shaped members, wherein a leg of each U-shaped member engages a pivot housing; and the legs removeably engage the pivot housings by sliding the legs into holes in the pivot housings; and the legs each contain a spring biased push button hold within the pivot housing.

4. The infant swing of claim 3 wherein pressing on a spring biased release button on the pivot housing depresses the push button, which allows the leg to be removed from the hole.

5. An infant swing comprising:

a seat for holding an infant, the seat comprising a padded seating area for an infant and a seat frame that supports said padded seating area, the seat frame comprising at least two upwardly extending arms;

two pivot housings rotatably connected to the at least two upwardly extending arms;

a support frame that extends upwardly from a substantially planar surface, the support frame engaging the pivot housings and allowing the seat to rotate freely about the pivot housings;

at least two feet in contact with the substantially planar surface, engaging the frame, and extending outside an outer perimeter of the frame; and wherein the support frame comprises two generally U-shaped members having a padding material covering said members, said padding material tapering in thickness from an upper portion to a lower portion of said U-shaped members so that the padding material is thicker at the lower portions of the U-shaped members closer to the planar surface.

6. The infant swing of claim 5 wherein padding covers the frame between the at least two feet and the pivot housings.

7. The infant swing of claim 5 wherein the feet are conically shaped so that a larger diameter end of said feet rest on said planar surface.

8. The infant swing of claim 7 further comprising horizontally aligned parallel support legs, wherein at least two of the parallel legs are padded in an area of the parallel legs between the feet and the pivot housing and the support legs are joined to conical feet at the lower ends of the parallel legs and are covered with a padding material.

9. An infant swing comprising:

a seat for holding an infant, the seat comprising a padded seating area for an infant and a seat frame that supports said padded seating area, the seat frame comprising at least two upwardly extending arms;

two pivot housings rotatably connected to the at least two upwardly extending arms;

a support frame that extends upwardly from a substantially planar surface, the support frame engaging the pivot housings and allowing the seat to rotate freely about the pivot housings;

wherein at least one of the pivot housings contains a drive assembly including a motor to swing the upwardly extending arm joined to an axle;

wherein the motor drives a worm shaft that meshingly engages a rotatable gear with a rod mounted eccentrically thereon, the rod engaging a slot in an arm plate such that rotation of the motor results in an eccentric movement of the rod that rotates the arm plate, which is provided with at least one wire secured to said arm plate and being formed in a U-shape to form a flexible pusher which pushes a stud on a stud plate that rotates the axle to thereby rotate the upwardly extending arm.

10. An infant swing comprising:

a seat for holding an infant, the seat comprising a padded seating area for an infant and a seat frame that supports said padded seating area, the seat frame comprising at least two upwardly extending arms;

two pivot housings rotatably connected to the at least two upwardly extending arms;

a support frame that extends upwardly from a substantially planar surface, the support frame engaging the pivot housings and allowing the seat to rotate freely about the pivot housings;

wherein at least one of the pivot housings containS a drive assembly including a motor to swing the upwardly extending arm joined to an axle;

wherein the motor drives a worm shaft that meshingly engages a rotatable gear with a rod mounted eccentrically thereon, the rod engaging edges of a partial slot in an arm plate during a first portion of a full rotation of said gear such that rotation of the motor results in an eccentric movement of the rod that in turn pushes the arm plate, which is provided with a wire secured at one end to the arm plate and extends away from said arm plate and is bent into a U-shape to provide a flexible pusher arm which pushes a stud on a stud plate that rotates the axle; and the edges of said partial slot being displaced from said stud during a second portion of full rotation of said gear.

11. The infant swing of claim 10 wherein the upwardly extending arm moves in a second direction under the influence of gravity during a second portion of the full rotation of said gear.

* * * * *